US006257286B1

(12) United States Patent
Gaetano

(10) Patent No.: US 6,257,286 B1
(45) Date of Patent: Jul. 10, 2001

(54) SPRAY VALVE FOR FOOD PRODUCT AND DISPENSING APPARATUS

(75) Inventor: Giovanni Gaetano, Dublin, OH (US)

(73) Assignee: Norse Dairy Systems, Inc., Columbus, OH (US)

( * ) Notice: Subject to any disclaimer, the term of this patent is extended or adjusted under 35 U.S.C. 154(b) by 0 days.

(21) Appl. No.: 09/383,334

(22) Filed: Aug. 26, 1999

(51) Int. Cl.[7] ..... B65B 43/42
(52) U.S. Cl. ..... 141/129; 141/258
(58) Field of Search ..... 141/82, 67, 23, 141/27, 285, 302, 305, 129, 185, 172, 258, 100, 105, 235, 392; 222/334, 389, 61; 239/583, 584, 533.1

(56) References Cited

U.S. PATENT DOCUMENTS 3,901,279 * 8/1975 Schnell ..... 452/31
4,235,265 * 11/1980 Feliks ..... 141/85
4,293,010 * 10/1981 Winiasz ..... 141/392
4,437,498 * 3/1984 Pankratz et al. ..... 141/89
4,500,273 * 2/1985 Anderson ..... 141/258
4,913,202 * 4/1990 Miller et al. ..... 141/104
5,065,910 * 11/1991 Fiedler ..... 141/117
5,080,148 * 1/1992 Florida ..... 141/258
5,127,449 * 7/1992 Mueller et al. ..... 141/258
5,361,943 * 11/1994 Du ..... 222/334
5,524,683 * 6/1996 Mueller ..... 141/129

* cited by examiner

*Primary Examiner*—Gregory L. Huson
*Assistant Examiner*—Khoa Huynh
(74) *Attorney, Agent, or Firm*—Standley & Gilcrest LLP

(57) ABSTRACT

A valve suitable for dispensing a food product, and a method and apparatus for distributing a food product into a series of containers via the valve. The valve comprises a food product chamber, a fluid chamber, an inlet valve, and an outlet valve. The food product chamber comprises a cylinder and a piston which is adapted to move within the cylinder. The cylinder has an inlet and an outlet. The fluid chamber is adapted to actuate the piston in a reciprocating motion comprising an uptake stroke and an expulsion stroke. The inlet valve is adapted to open the inlet during the uptake stroke, and to close the inlet during the expulsion stroke. Conversely, the outlet valve is adapted to open the outlet during the expulsion stroke, and to close the outlet during the uptake stroke. The diameter of the food product chamber is less than the diameter of the fluid chamber. The valve optionally includes a reciprocating mechanism which is adapted to move the valve in a reciprocating motion which facilitates the distribution of the food product.

23 Claims, 9 Drawing Sheets

SPRAY VALVE FOR FOOD PRODUCT AND DISPENSING APPARATUS

TECHNICAL FIELD OF THE INVENTION

The present invention is in the field of food dispensing valves and apparatuses.

BACKGROUND OF THE INVENTION

This invention relates to a spray valve and dispensing apparatus for dispensing a viscous food product.

It is often desirable to be able to provide thin, uniform sprays of viscous, liquid food products, such as in applications where it is desirable to provide coatings of glazes, syrups, and colloidal materials. These applications may be in the areas of bakery, confectionery, frozen yogurt, and dairy products. Coatings may be provided on a variety of surfaces, but the present invention is particularly applicable to providing a coating on the inner surface of containers such as baked ice cream cone shells.

One of the problems faced in the dispensing of viscous food products is to maintain the consistency of flow during dispensing.

Another challenge is to provide a viscous, liquid food product dispensing system that resists fouling during periods when the system is idle.

Still another challenge is to provide a system for dispensing viscous, liquid food products which has minimal parts and disassembles easily.

Yet another challenge is to provide a system for dispensing viscous, liquid food products which is sanitary and is comprised of stainless steel and/or FDA approved plastics.

SUMMARY OF THE INVENTION

Preferred embodiments of the present invention overcome some or all of the above challenges. The present invention includes valves, dispensing apparatuses, and methods of dispensing a food product.

In general terms, the valve comprises: (A) a food product chamber, the food product chamber comprising a cylinder and a piston adapted to move within the cylinder, the cylinder having an inlet and an outlet; (B) a fluid chamber adapted to actuate the piston in a reciprocating motion comprising an uptake stroke and an expulsion stroke; (C) an inlet valve adapted to open the inlet during the uptake stroke, and to close the inlet during the expulsion stroke; and (D) an outlet valve adapted to open the outlet during the expulsion stroke, and to close the outlet during the uptake stroke; wherein the diameter of the food product chamber is less than the diameter of the fluid chamber.

Preferably, the food product chamber has a bottom in which the inlet and the outlet are located. In addition, it is preferred that the fluid chamber includes an adjustment mechanism so as to be able to control the distance of the uptake stroke and/or the expulsion stroke. It is preferred that the expulsion stroke ends with the piston at the bottom of the food product chamber in order to fully empty the food product chamber at the bottom of every expulsion stroke. For example, it is preferred that the valve is an anti-seizing valve that can be set by a top adjustment stem to bottom out, thereby expelling substantially all of the viscous food product at the end of the expulsion stroke.

The fluid chamber may be a gas or hydraulic cylinder. In the preferred embodiment, the fluid chamber has a bore step-down ratio from 3 inches to ⅞ inch.

The valve preferably uses pressure, without injecting air into the food product, in order to dispense the food product. For example, a pressure of about 700 to about 800 pounds per square inch (psi) may be used to atomize and dispense a relatively viscous food product. On the other hand, a lower pressure may be used to dispense a relatively thin food product. By using only pressure to dispense the food product, preferred embodiments of the present invention provide an improved coating of the food product on a desired surface, e.g., the inside of an ice cream cone shell. In particular, the coating is more uniform. It also provides several other benefits. For example, it eliminates the need to filter the injected air to remove contaminants. Moreover, it wastes less food product. Specifically, the food product splatters less when it is dispensed, and less food product is lost to the atmosphere. When air is injected into the food product, a significant amount of the food product is lost to the atmosphere when it is dispensed, e.g., about 1 to 2 grams of chocolate is lost to the atmosphere when it is sprayed on the inside of an ice cream cone shell using known techniques.

Optionally, the valve has an outlet conduit which includes a removable insert portion comprising an outlet nozzle. This may be a removable spray body/channel portion.

In some applications, heating the food product may provide a benefit such as reduced viscosity. In such instances, the valve may include a heater to heat the food product chamber.

The present invention also includes a reciprocating valve for providing reciprocation during the dispensing of the product. This valve may be provided with the optional or preferred features of the above-described valve. In broadest terms, the reciprocating valve comprises: (A) a food product chamber, the food product chamber comprising a cylinder and a piston adapted to move within the cylinder, the cylinder having an inlet and an outlet, the food product chamber having a bottom and the outlet being located in the bottom of the food product chamber so as to provide a food product outlet direction; (B) a fluid chamber adapted to actuate the piston in a reciprocating motion comprising an uptake stroke and an expulsion stroke, the diameter of the fluid chamber being greater than the diameter of the food product chamber; (C) an inlet valve adapted to open the inlet during the uptake stroke, and to close the inlet during the expulsion stroke; (D) an outlet valve adapted to open the outlet during the expulsion stroke, and to close the outlet during the uptake stroke; and (E) a reciprocating mechanism adapted to raise and lower the reciprocating valve in a reciprocating motion along an axis substantially parallel to the food product outlet direction.

The reciprocating mechanism may be any appropriate mechanical reciprocating mechanism for use in the desired application. For example, the reciprocating mechanism may be selected from the group consisting of reciprocating cam-driven mechanisms and reciprocating fluid-driven mechanisms.

The present invention also includes a dispensing apparatus using any of the valves of the present invention in their many fundamental and optional embodiments. The apparatus may be used for distributing a spray of a food product into a series of containers. One embodiment of the apparatus comprises: (A) a container transport apparatus adapted to transport the containers in a series to and beyond a filling position; (B) a filling apparatus positioned so as to fill one of the containers when the container is in the filling position, the filling apparatus comprising a valve, the valve comprising: (1) a food product chamber, the food product chamber comprising a cylinder and a piston adapted to move within the cylinder, the cylinder having an inlet and an outlet; (2) a fluid chamber adapted to actuate the piston in a reciprocating motion comprising an uptake stroke and an expulsion stroke; (3) an inlet valve adapted to open the inlet during the uptake stroke, and to close the inlet during the expulsion stroke; and (4) an outlet valve adapted to open the outlet during the expulsion stroke, and to close the outlet during the uptake stroke; wherein the diameter of the food product chamber is less than the diameter of the fluid chamber.

The container transport apparatus may be any appropriate container transport apparatus for use in the desired application. For instance, the container transport apparatus may be selected from the group consisting of linear transport apparatuses and turntable transport apparatuses.

The apparatus may also include a food product circulation pump adapted to supply the inlet with a flow of the food product. The apparatus of the present invention may be used with pressure amplifiers in order to provide reliable flow and discrete dispensing of the food product.

The present invention also includes another embodiment of an apparatus for distributing a spray of a food product into a series of containers. This embodiment of the apparatus comprises: (A) a container transport apparatus adapted to transport the containers in a series to and beyond a filling position; (B) a filling apparatus positioned so as to fill one of the containers when the container is in the filling position, the filling apparatus comprising a reciprocating valve, the reciprocating valve comprising: (1) a food product chamber, the food product chamber comprising a cylinder and a piston adapted to move within the cylinder, the cylinder having an inlet and an outlet, the food product chamber having a bottom and the outlet being located in the bottom of the food product chamber so as to provide a food product outlet direction; (2) a fluid chamber adapted to actuate the piston in a reciprocating motion comprising an uptake stroke and an expulsion stroke, the diameter of the fluid chamber being greater than the diameter of the food product chamber; (3) an inlet valve adapted to open the inlet during the uptake stroke, and to close the inlet during the expulsion stroke; (4) an outlet valve adapted to open the outlet during the expulsion stroke, and to close the outlet during the uptake stroke; and (5) a reciprocating mechanism adapted to raise and lower the valve in a reciprocating motion along an axis substantially parallel to the food product outlet direction. This apparatus may be provided with the optional or preferred features of the fixed or reciprocating valve as described above. This apparatus may also be provided with the optional or preferred features of the dispensing apparatus described above.

In a preferred embodiment, the reciprocating valve comprises a spray nozzle that extends into one of the containers or the associated container holder when the container is in the filling position, such that the spray nozzle reciprocates within the container during the expulsion stroke.

The present invention also includes a method of dispensing a food product into a container. A preferred method comprises: (A) maintaining a flow of the food product; (B) conducting the flow of the food product into at least one valve, the valve comprising: (1) a food product chamber, the food product chamber comprising a cylinder and a piston adapted to move within the cylinder, the cylinder having an inlet and an outlet; (2) a fluid chamber adapted to actuate the piston in a reciprocating motion comprising an uptake stroke and an expulsion stroke, the diameter of the fluid chamber being greater than the diameter of the food product chamber; (3) an inlet valve adapted to open the inlet during the uptake stroke, and to close the inlet during the expulsion stroke; and (4) an outlet valve adapted to open the outlet during the expulsion stroke, and to close the outlet during the uptake stroke; (C) transporting the container to a filling position beneath the valve; and (D) actuating the valve so as to pump the food product through the outlet into the container while reciprocating the outlet within the space defined by the container or the associated container holder so as to coat the inside of the container with the food product.

The present invention also includes another method of dispensing a food product into a container. This method comprises: (A) maintaining a flow of the food product; (B) conducting the flow of the food product into at least one valve, the valve comprising: (1) a food product chamber, the food product chamber comprising a cylinder and a piston adapted to move within the cylinder, the cylinder having an inlet and an outlet, the food product chamber having a bottom and the outlet being located in the bottom of the food product chamber so as to provide a food product outlet direction; (2) a fluid chamber adapted to actuate the piston in a reciprocating motion comprising an uptake stroke and an expulsion stroke, the diameter of the fluid chamber being greater than the diameter of the food product chamber; (3) an inlet valve adapted to open the inlet during the uptake stroke, and to close the inlet during the expulsion stroke; (4) an outlet valve adapted to open the outlet during the expulsion stroke, and to close the outlet during the uptake stroke; and (5) a reciprocating mechanism adapted to raise and lower the valve in a reciprocating motion along an axis substantially parallel to the food product outlet direction; (C) transporting the container to a filling position beneath the valve; and (D) actuating the valve so as to pump the food product through the outlet into the container while reciprocating the outlet within the space defined by the container or a respective container holder so as to coat the inside of the container with the food product.

Either of the aforementioned methods may be practiced with the optional or preferred features of the valves and dispensing apparatuses described above.

Although described with respect to spraying a viscous food product, it will be appreciated that similar advantages may be obtained in other applications of the present invention. In addition, other objects and advantages of the present invention will be readily apparent from the following descriptions of the drawings and preferred embodiments.

DETAILED DESCRIPTION OF THE PREFERRED EMBODIMENT(S)

In accordance with the foregoing summary, the following provides a detailed description of a preferred embodiment of the invention that is currently considered to be the best mode. The valve of the present invention will be described primarily with regard to controlling the flow of a liquid, semi-liquid, or viscous food product. However, it should be recognized that the valve of the present invention may be utilized to control the flow of practically any other type of liquid, semi-liquid, or viscous substance.

Figure 1:
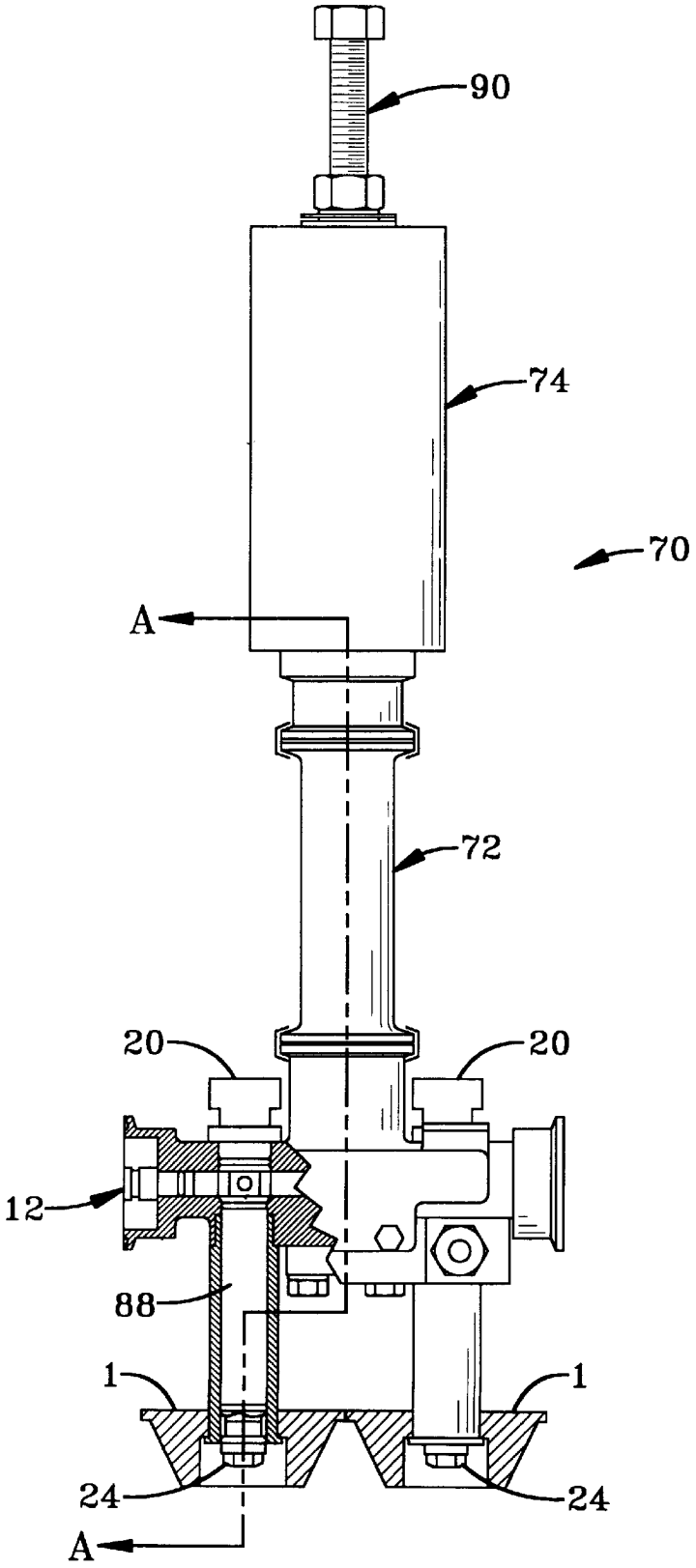
FIG. 1 is a side elevation/cross section view of a preferred embodiment of a valve of the present invention.
Figure 2:
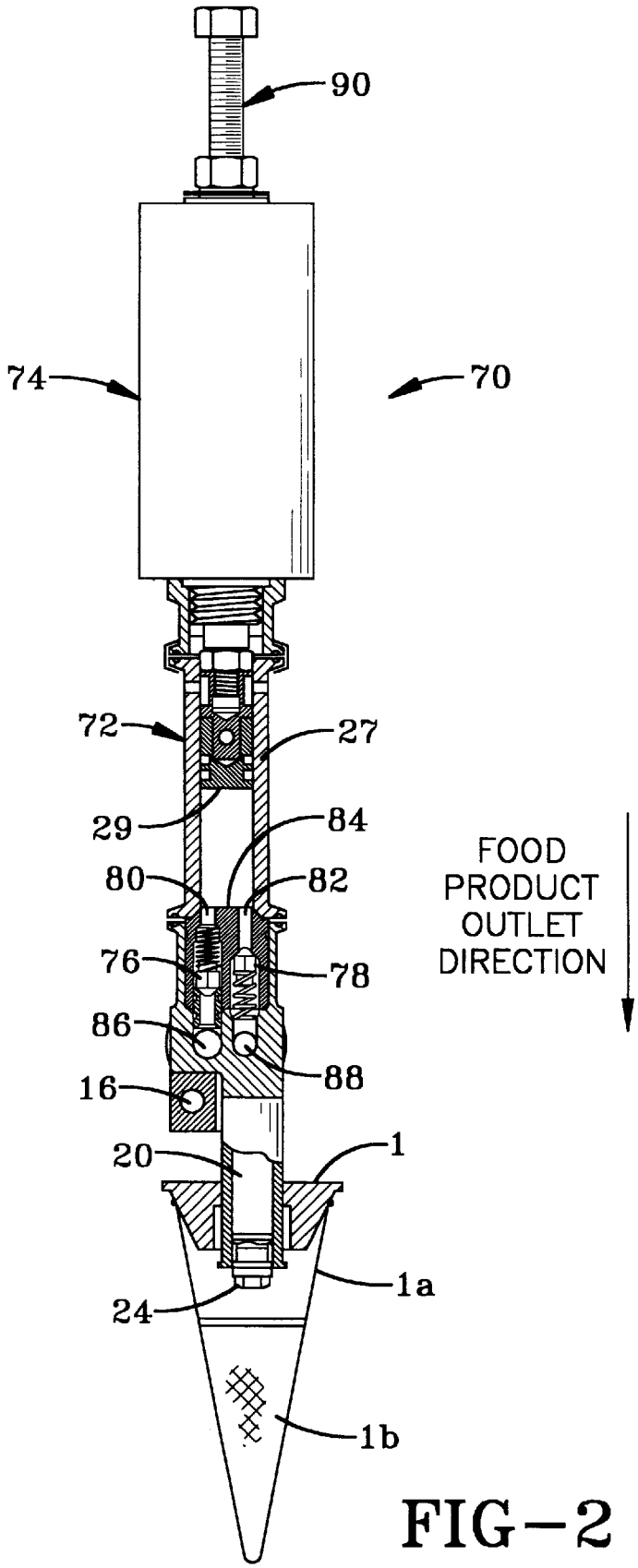
FIG. 2 is another side elevation/cross section view of the valve shown in FIG. 1.

FIG. 1 is a side elevation/cross section view of a preferred embodiment of a valve 70 of the present invention. FIG. 2 is another side elevation/cross section view of the valve 70 along the line A—A of FIG. 1. The valve 70 includes a food product chamber 72, a fluid chamber 74, an inlet valve 76, and an outlet valve 78.

The food product chamber is comprised of a cylinder 27 and a piston 29. The piston 29 is adapted to move within the cylinder 27. In this embodiment, the fluid chamber 74 is adapted to actuate the piston 29 in a reciprocating motion comprising an uptake stroke and an expulsion stroke. The cylinder 27 is not limited to being a structure that has a circular cross section. It shall be understood that the cylinder 27 may be any shape which allows a desired movement of the piston 29.

The cylinder 27 defines an inlet 80 and an outlet 82. The inlet 80 and the outlet 82 are preferably located in the bottom 84 of the food product chamber 72. The location of the inlet 80 and the outlet 82 may vary according to the orientation and intended use of the valve 70. For example, the inlet 80 and the outlet 82 may be located in the top or a side wall of the food product chamber 72.

The inlet 80 and the outlet 82 each preferably include a passageway or bore that extends through the bottom 84 of the food product chamber 72 to a predetermined location. In this example, the inlet 80 includes a passageway 86, and the outlet 82 includes a passageway 88. The passageway 86 is adapted to receive a food product, e.g., melted chocolate, from an external source and direct it to the food product chamber 72. On the other hand, the passageway 88 is adapted to receive the food product from the food product chamber 72 and direct it to a predetermined location where it may be dispensed. In FIG. 2, the arrow labeled "Food Product Outlet Direction" indicates the direction of the flow of the food product through the outlet 82 prior to being dispensed from the valve 70. It should be recognized that the nozzle 24 or any other similar device may redirect the food product away from the food product outlet direction.

The uptake stroke of the piston 29 creates a change in pressure which causes the inlet valve 76 to open the inlet 80. This change in pressure also causes the outlet valve 78 to close the outlet 82. As a result, the food product may flow through the inlet 80 and fill, either completely or partially, the food product chamber 72 during the uptake stroke of the piston 29. Thereafter, the expulsion stroke of the piston 29 creates another change in pressure which causes the inlet valve 76 to close the inlet 80 and the outlet valve 78 to open the outlet 82. Consequently, the movement of the piston 29 during the expulsion stroke preferably forces a desired amount of the food product in the food product chamber 72 out through the outlet 82 to a predetermined destination.

Although specific embodiments of the inlet valve 76 and the outlet valve 78 are discussed herein, those skilled in the art should recognize that other similar or conventional embodiments of the inlet and outlet valves and methods of controlling their operation may be utilized in the present invention.

The fluid chamber 74 may be a gas cylinder, a hydraulic cylinder, or any other similar mechanism. The diameter of the fluid chamber 74 is preferably greater than the diameter of the food product chamber 72 for optimum performance. The fluid chamber 74 preferably includes an adjustment mechanism 90. The adjustment mechanism 90 may be adjusted to control the distance of the uptake stroke and/or the expulsion stroke. The adjustment mechanism 90 may be any adjustment mechanism that can be used in connection with a gas or hydraulic cylinder to perform the same or similar function. In a preferred embodiment of the valve 70, the adjustment mechanism 90 may be used to control the distance of the expulsion stroke such that the piston 29 bottoms out against the bottom 84 of the food product chamber 72 in order to expel substantially all of the food product through the outlet 82 at the conclusion of every expulsion stroke.

The valve 70 preferably includes at least one outlet conduit. The outlet conduit is comprised of an insert portion 20. The insert portion 20 is preferably adapted to slide into and out of a portion of the passageway 88. The insert portion 20 preferably lines the walls of that portion of the passageway 88, and it is adapted to receive the food product that flows through that portion of the passageway 88. The insert portion 20 preferably includes a nozzle 24 through which the food product is discharged from the valve 70. The nozzle 24 may cause the food product to be sprayed in a desired pattern from the valve 70. If the nozzle 24 or any other portion of the insert portion 20 becomes clogged or otherwise gummed up, the insert portion 20 may be slid out of the passageway 88 to be cleaned or replaced with another insert portion 20.

In this example, the valve 70 is adapted to simultaneously discharge the food product in a plurality of locations. In particular, the passageway 88 has two branches. An outlet conduit is inserted into each branch of the passageway 88. Each outlet conduit guides the food product to a respective location to be discharged through a respective nozzle 24.

Optionally, the valve 70 may include at least one sleeve former 1. In the example shown in FIGS. 1 and 2, each sleeve former 1 is adapted to abut against the inside of a container holder 1*a* of a container transport apparatus as the valve 70 is lowered to a position for discharging the food product. The container holder 1*a* holds an ice cream cone 1*b*. After the sleeve formers 1 abut against the inside of the container holders 1*a*, substantially the rest of the valve 70 continues to move a predetermined distance downward relative to the sleeve formers 1. This movement exposes the nozzle 24 and puts it in position to spray chocolate onto the inside of the cone 1*b*. The valve 70 may descend low enough such that the nozzle 24 is within the boundaries of the container 1*b*. After reaching its lowest point, the valve 70 may move back upward. The reciprocating motion may be repeated, if desired, within the same container 1*b* and/or container holder 1*a*, or the valve 70 may be completely withdrawn to allow the next container 1*b* to move into the filling position.

Certain food products and other substances may flow through the valve 70 more easily if kept within a desired temperature range. For example, chocolate may flow through the valve 70 better if it is kept sufficiently warm so that it remains fluid. In such instances, the valve 70 preferably includes a heater 16 in a position where it is adapted to heat the passageway 86, the passageway 88, and/or the food product chamber 72.

Depending on the use and design of the valve 70, it may be desired to prevent the food product from flowing through certain ports of the passageway 86 or the passageway 88. In such instances, a plug 12 or any other suitable means may be used to close a particular port. For example, FIG. 1 shows a plug 12 which closes a port of the passageway 88 which is not being utilized.

Figure 3:
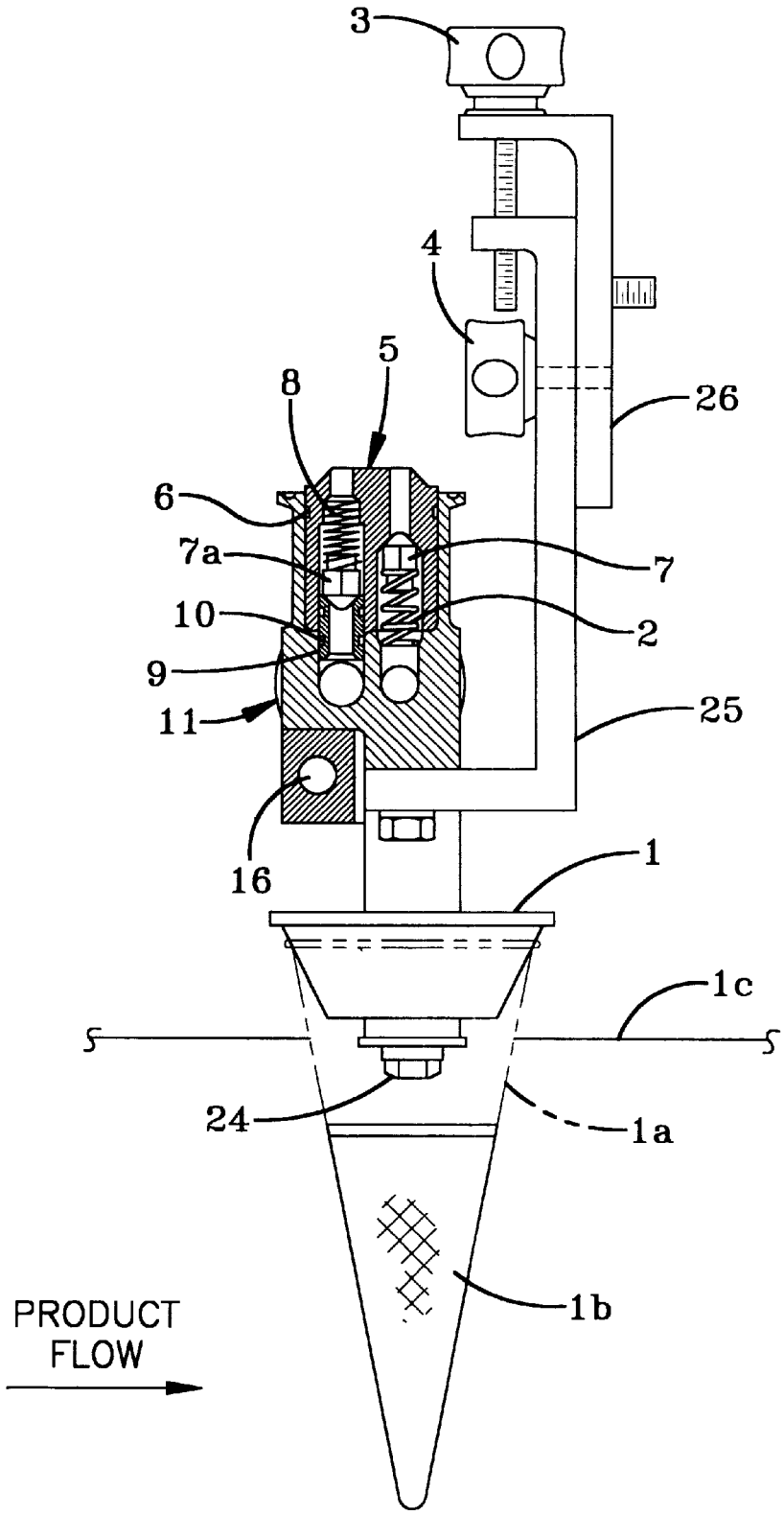
FIG. 3 is a partial, detailed, side elevation/cross section view of the valve shown in FIG. 1.

FIG. 3 shows a partial, detailed, side elevation/cross section view of the valve 70. The arrow marked "Product Flow" indicates the direction in which the containers 1*b* are moved by a container transport apparatus 1*c* to reach, and be registered in, the filling position beneath the outlet nozzle 24. The container transport apparatus 1*c* may be a linear transport apparatus, a turntable transport apparatus, or any other type of conveyor or rotary apparatus appropriate for use in the desired application.

FIG. 3 shows sleeve former 1 which is adapted to engage the container holder 1*a* which houses the ice cream cone shell 1*b*. Also shown in FIG. 3 is the spring housing 5 which is contained in manifold 11 and sealed by o-ring 6. Spring housing 5 features check seat 9, check 7*a*, and spring 8 of the inlet valve 76 and check 7 and spring 2 of the outlet valve 78. Also shown in FIG. 3 is o-ring 10. The manifold 11 is optionally heated by heater 16.

Also shown in FIG. 3 are a bracket 25 and a plate 26 which are positioned with respect to one another by action of spanner nut assembly 3 and spanner nut 4. Bracket 25 and plate 26 may be connected to a reciprocating mechanism which is adapted to move the valve 70 in a reciprocating motion to facilitate the distribution of the food product.

Figure 4:
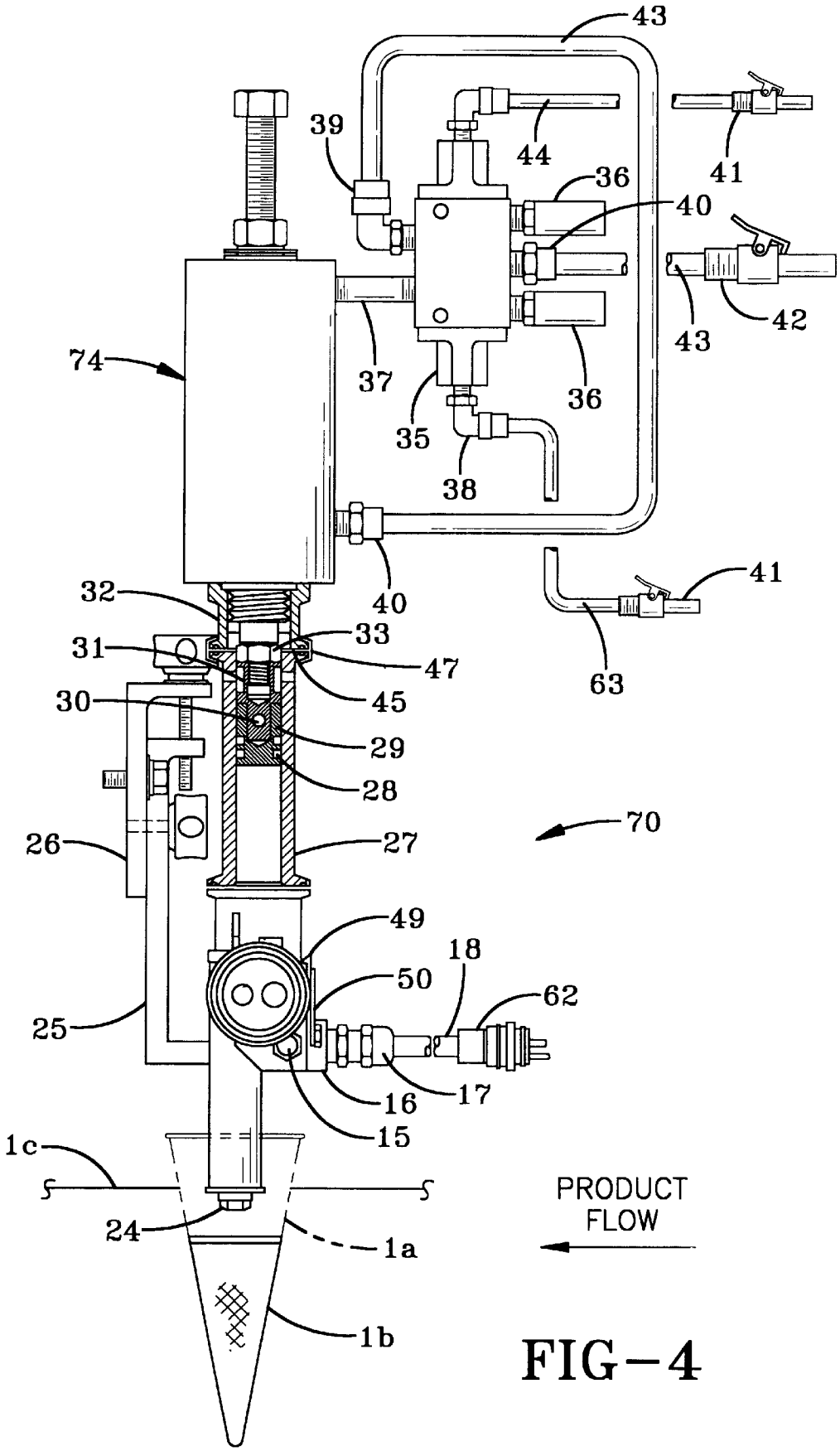
FIG. 4 is a detailed, side elevation/cross section view of the valve shown in FIG. 1 (the sleeve former is not shown)

FIG. 4 is another detailed view of the valve 70 and associated components. FIG. 4 shows plug 15, heater 16, cord grip 17, and cable 18. It also shows bracket 25, plate 26, cylinder 27, o-ring 28, piston 29 and retaining pin 30. Adapter 31, adapter 32, nut 33, fluid chamber 74, pilot valve 35, mufflers 36, and nipple 37 are shown. Also shown in FIG. 4 are swivel elbow joint 38, swivel elbow joint 39, connectors 40, inserts 41, insert 42, tubing 43, tubing 44, and gasket 45. Also shown are clamp 47, spring 49, spring 50, woodhead plug 62, and tubing 63. Items 35 through 44 and 63 help to control the fluid dynamics of the fluid chamber 74.

Figure 5:
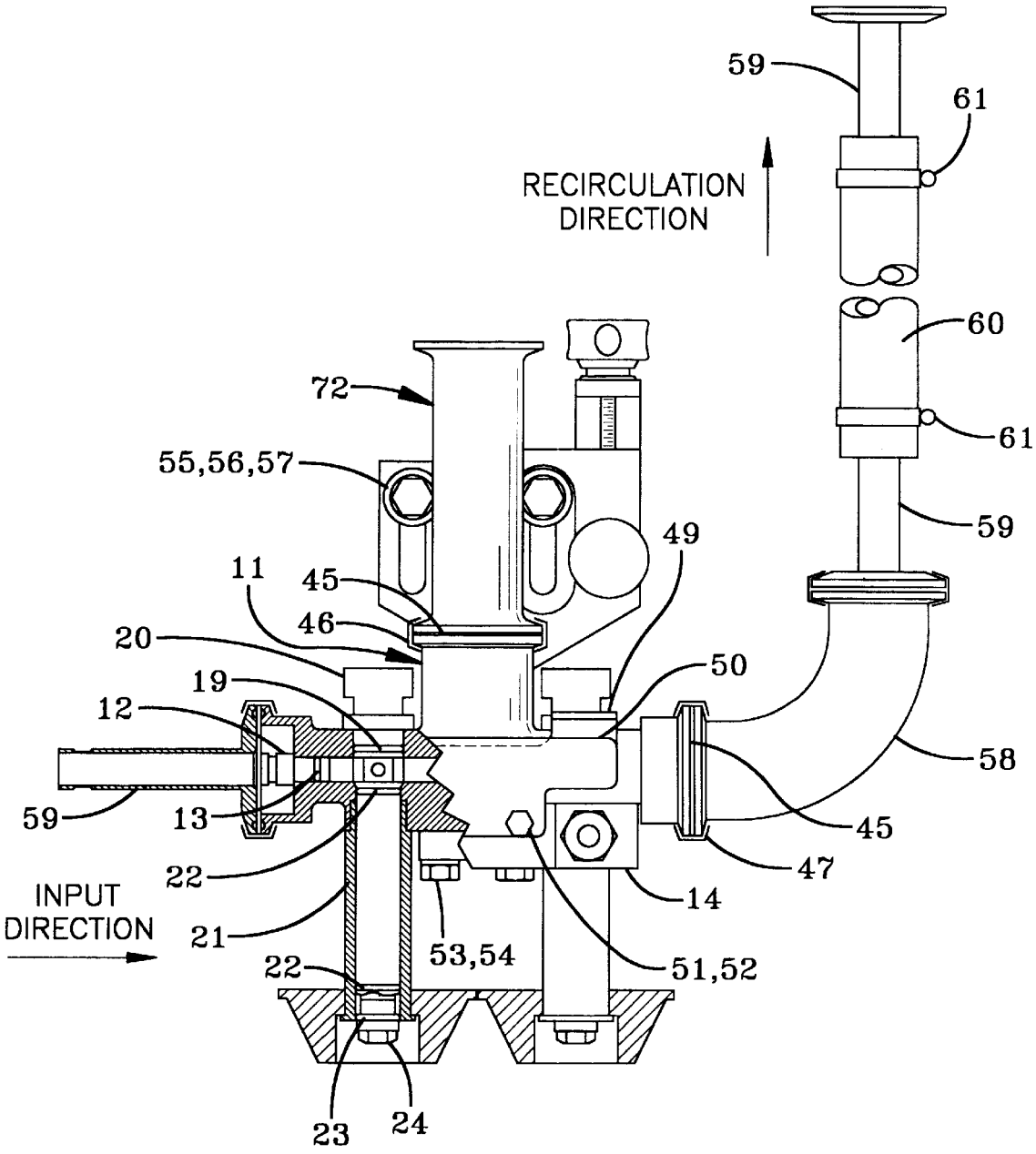
FIG. 5 is another partial, detailed, side elevation/cross section view of the valve shown in FIG. 1.

FIG. 5 shows manifold 11, plug 12, o-ring 13, heater 14, and o-ring 19. FIG. 5 also shows insert portion 20, sleeve 21, o-rings 22, o-ring 23, and nozzle 24. Also shown are gaskets 45, special clamp 46, clamp 47, spring 49, and spring 50. Hex screw 51, washer 52, hex screw 53, washer 54, hex screw 55, washer 56, washer 57, elbow 58, hose adapters 59, hose 60, hose clamps 61, and food product chamber 72 are also shown in FIG. 5. In FIG. 5, hose 60 and hose clamp 61 are not shown on the input side of the valve 70 for clarity.

With reference to FIG. 5, the food product enters the valve 70 in the direction of the arrow labeled "Input Direction" via a hose 60. Excess food product that is not dispensed through the nozzles 24 during the expulsion stroke may exit the valve via a hose 60 in the direction of the arrow labeled "Recirculation Direction." The excess food product is preferably circulated to a storage tank from which it may be input again to the valve 70.

Figure 6:
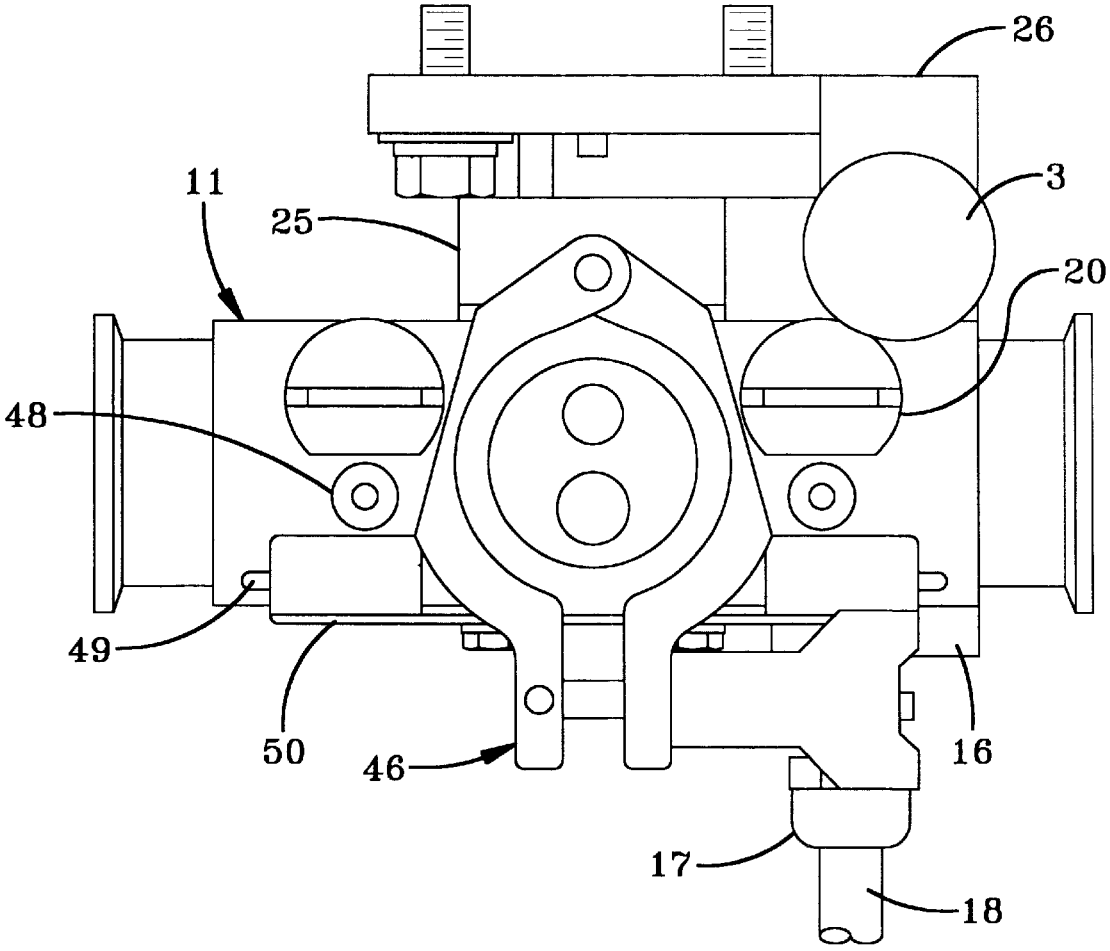
FIG. 6 is a top plan view of the valve shown in FIG. 1 (the fluid chamber and the piston are not shown for clarity)

FIG. 6 is a top plan view of the valve 70. The piston 29 and the fluid chamber 74 are not shown for clarity. FIG. 6 shows spanner nut 3, manifold 11, heater 16, cord grip 17, cable 18, and insert portion 20. Also shown are bracket 25, plate 26, special clamp 46, shoulder bolt 48, spring 49, and spring 50. In this figure, the insert portions are in unlocked positions which allow them to be removed.

Figure 7:
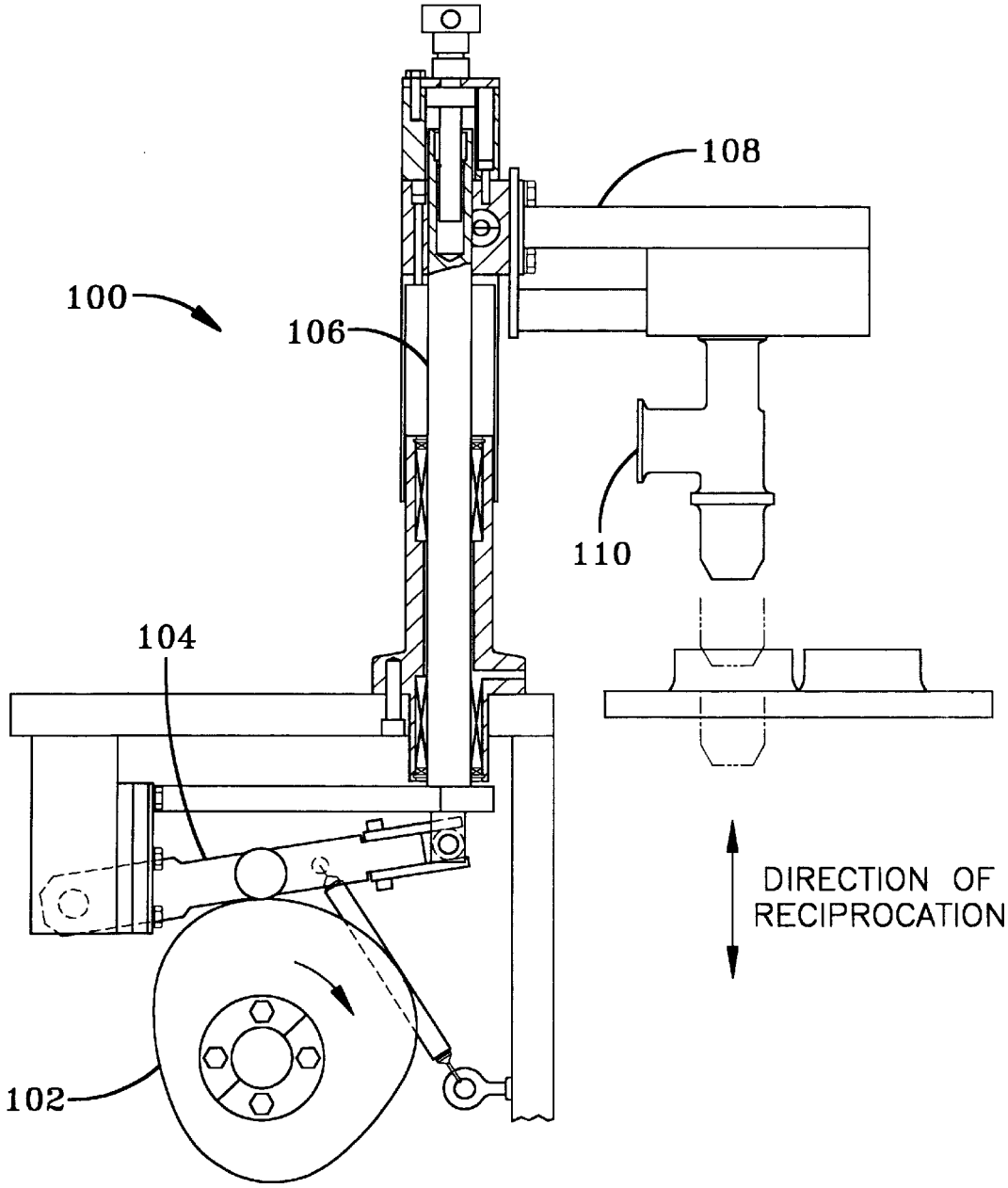
FIG. 7 is a side elevation/cross section view of a preferred embodiment of a reciprocating mechanism of the present invention.

FIG. 7 is a side elevation/cross section view of a preferred embodiment of a reciprocating mechanism 100 of the present invention. The reciprocating mechanism 100 may be a cam-driven mechanism, a fluid-driven mechanism, or any other type of device which is adapted to produce a desired reciprocating motion. This embodiment of the reciprocating mechanism 100 is driven by cam 102. Rotation of the cam 102 induces rotation of the lever arm 104. The lever arm 104 is connected to a shaft 106, and the shaft 106 is connected to support 108. Support 108 engages the valve 110. Consequently, the rotation of the lever arm 104 causes the shaft 106, the support 108, and the valve 110 to reciprocate in the direction indicated by the arrow labeled "Direction of Reciprocation." In a preferred embodiment of the invention, the direction of reciprocation is substantially parallel to the food product outlet direction. However, it should be recognized that the angular relationship between the direction of reciprocation and the food product outlet direction may vary according to the application. For example, the direction of reciprocation may be vertical when the food product outlet direction is horizontal.

When a container is in a filling position, the reciprocating mechanism may cause the valve to reciprocate within the container and/or its container holder during the expulsion stroke. Referring back to FIGS. 2–4, the container 1*b* is in a filling position. A reciprocating mechanism, not shown, has lowered the valve 70 into the container holder 1*a*. After the optional sleeve former 1 has engaged the container holder 1*a*, the reciprocating mechanism continues to cause the outlet conduit of the valve 70 to move a predetermined distance downward relative to the sleeve former 1. After the valve 70 reaches its lowest point, the reciprocating mechanism causes the valve 70 to move back upward. The distance of the reciprocating motion may be controlled using techniques well known in the art. The reciprocating motion may be repeated, if desired, within the same container 1*b* and/or container holder 1*a*, or the valve 70 may be completely withdrawn to allow the next container 1*b* to move into the filling position.

In a preferred embodiment of the present invention, the timing of the uptake stroke and the expulsion stroke is coordinated with the reciprocating motion of the valve 70 so that the food product is dispensed at an appropriate time for a particular application. For instance, the uptake stroke or the expulsion stroke may be timed to start as the valve 70 is moving downward, as the valve 70 is moving upward, or when the valve 70 is at its lowest point. It should also be recognized that either of the strokes may be started and/or completed when the valve 70 is in a moving or stationary position.

Figure 8:
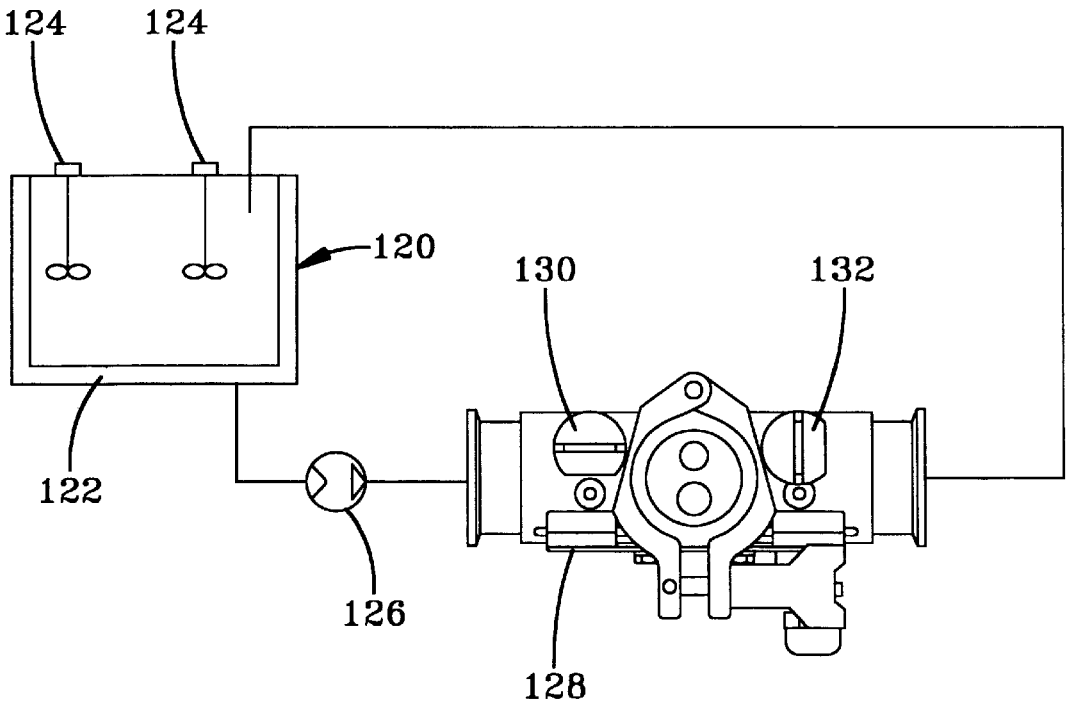
FIG. 8 is a symbolic diagram of a food processing system which may utilize a preferred embodiment of the valve of the present invention.

FIG. 8 is a symbolic diagram of a food processing system that may utilize a preferred embodiment of a valve of the present invention. In this example, chocolate is stored in a chocolate tank assembly 120. The chocolate tank assembly 120 is preferably a water jacketed, heated tank. The water jacket is shown at 122. The chocolate tank assembly may also include agitators 124. A pump 126 pumps the chocolate to the valve 128. The valve 128 includes insert portions 130, 132. The insert portion 130 is in an unlocked position as indicated by its stem, and the insert portion 132 is in a locked position as indicated its stem. As a result, the insert portion 130 may be removed, if desired, for cleaning or replacement. The valve 128 receives the chocolate during the uptake stroke of its piston, and it dispenses the chocolate during the expulsion stroke of its piston. Excess chocolate that is not dispensed during the expulsion stroke is drawn back to the chocolate take assembly 120 by the pump 126. Meanwhile, the next container moves into a filling position. The cycle may then be repeated. As a result, the food processing system provides a circulating flow of chocolate.

As indicated by FIGS. 5 and 8, it is preferred that the food product is continuously circulated through the valve and system of the present invention. Continuous circulation of the food product helps to prevent the food product from solidifying in the valve or anywhere else in the system. It also helps to keep the food product warm. As a result, the valve and system of the present invention is significantly less likely to become clogged or otherwise fouled by the food product. In addition, it makes the food product easier to dispense.

Figure 9:
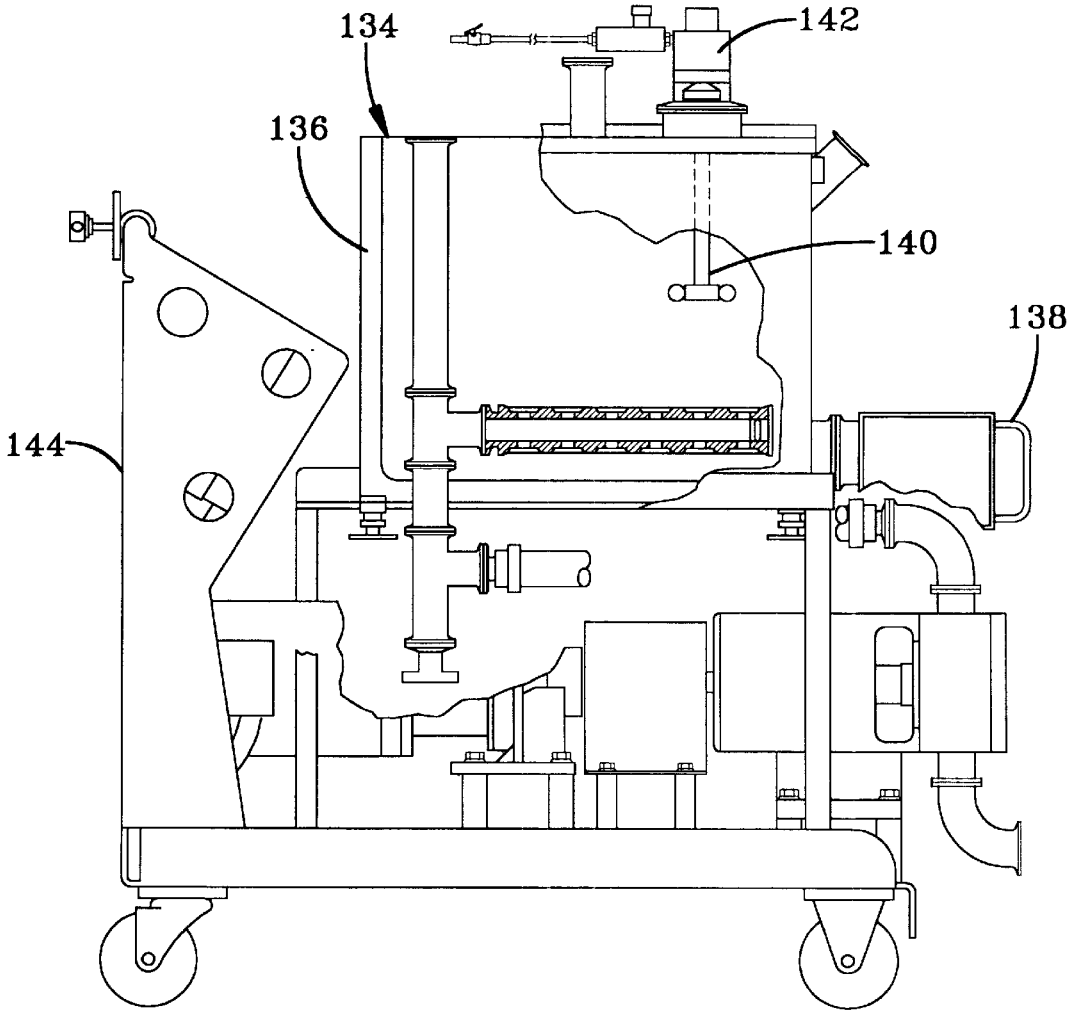
FIG. 9 is a side elevation/cross section view of a chocolate tank assembly which may be utilized in the food processing system of FIG. 8.

The chocolate tank assembly may be any type of device which is appropriate for use in the application. FIG. 9 shows a preferred embodiment of a chocolate tank assembly 134. The chocolate tank assembly 134 includes a water jacket 136 which is heated by heater 138. The chocolate tank assembly also includes at least one agitator 140 which is powered by air motor 142. FIG. 9 also shows pump 144 which is adapted to pump the chocolate from the chocolate tank assembly 134 to the valve. The pump 144 is also preferably adapted to recirculate excess, undispensed chocolate from the valve back to the chocolate tank assembly 134.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A valve comprising:

(A) a food product chamber, said food product chamber comprising a cylinder and a piston adapted to move within said cylinder, said cylinder having an inlet and an outlet, said outlet providing a food product outlet direction through said valve;

(B) a fluid chamber adapted to actuate said piston in a reciprocating motion comprising an uptake stroke and an expulsion stroke, the diameter of said fluid chamber being greater than the diameter of said food product chamber to facilitate placing a product in said food product chamber under at least about 700 psi of pressure during said expulsion stroke;

(C) an inlet valve adapted to open said inlet during said uptake stroke, and to close said inlet during said expulsion stroke;

(D) an outlet valve adapted to open said outlet during said expulsion stroke, and to close said outlet during said uptake stroke; and (E) a spray nozzle in fluid communication with said outlet;

wherein said spray nozzle is adapted to spray said product in a direction substantially transverse to said food product outlet direction during said expulsion stroke.

2. A valve according to claim 1 wherein said food product chamber has a bottom extending between the sides of said food product chamber, and said inlet and said outlet are located in the bottom of said food product chamber.

3. A valve according to claim 1 wherein said fluid chamber comprises an adjustment mechanism so as to be able to control the distance of said expulsion stroke.

4. A valve according to claim 1 wherein said food product chamber has a bottom, and said expulsion stroke ends with said piston at said bottom of said food product chamber.

5. A valve according to claim 1 wherein said outlet includes a passageway extending to said outlet nozzle, said valve further comprising:

an insert portion including said outlet nozzle, said insert portion lining at least a portion of the sides of said passageway, said insert portion adapted to be slid into and out of said passageway.

6. A valve according to claim 1 additionally comprising a heater to heat said food product chamber, said heater disposed below and in line with the length of said food product chamber such that heat convects up the length of said food product chamber.

7. A valve according to claim 1 further comprising a reciprocating mechanism adapted to raise and lower said food product chamber, said fluid chamber, said inlet valve, said outlet valve, and said spray nozzle in a reciprocating motion along an axis substantially parallel to said food product outlet direction.

8. A valve according to claim 7 wherein said valve is adapted to spray said product as said spray nozzle is being reciprocated.

9. A reciprocating valve comprising:

(A) a food product chamber, said food product chamber comprising a cylinder and a piston adapted to move within said cylinder, said cylinder having an inlet and an outlet, said food product chamber having a bottom and said outlet being located in the bottom of said food product chamber so as to provide a food product outlet direction;

(B) a fluid chamber adapted to actuate said piston in a reciprocating motion comprising an uptake stroke and an expulsion stroke, the diameter of said fluid chamber being greater than the diameter of said food product chamber;

(C) an inlet valve adapted to open said inlet during said uptake stroke, and to close said inlet during said expulsion stroke;

(D) an outlet valve adapted to open said outlet during said expulsion stroke, and to close said outlet during said uptake stroke; and (E) a reciprocating mechanism adapted to raise and lower said food product chamber, said fluid chamber, said inlet valve, and said outlet valve in a reciprocating motion along an axis substantially parallel to said food product outlet direction.

10. A reciprocating valve according to claim 9 wherein said fluid chamber comprises an adjustment mechanism so as to be able to control the distance of said expulsion stroke.

11. A reciprocating valve according to claim 9 wherein said food product chamber has a bottom, and said expulsion stroke ends with said piston at said bottom of said food product chamber.

12. A reciprocating valve according to claim 9 wherein said outlet includes a passageway extending to a predetermined location, said valve further comprising:

an insert portion including an outlet nozzle, said insert portion lining at least a portion of the sides of said passageway, said insert portion adapted to be slid into and out of said passageway.

13. A reciprocating valve according to claim 9 wherein said reciprocating mechanism is selected from the group consisting of reciprocating cam-driven mechanisms and reciprocating fluid-driven mechanisms.

14. A reciprocating valve according to claim 9 additionally comprising a heater to heat said food product chamber, said heater disposed below and in line with the length of said food product chamber such that heat convects up the length of said food product chamber.

15. An apparatus for distributing a spray of a food product into a series of containers, said apparatus comprising:

(A) a container transport apparatus adapted to transport said containers in a series to and beyond a filling position; and (B) a filling apparatus positioned so as to fill one of said containers when said one of said containers is in said filling position, said filling apparatus comprising a valve, said valve comprising:

(1) a food product chamber, said food product chamber comprising a cylinder and a piston adapted to move within said cylinder, said cylinder having an Inlet and an outlet, said outlet providing a food product outlet direction through said valve;

(2) a fluid chamber adapted to actuate said piston in a reciprocating motion comprising an uptake stroke and an expulsion stroke, the diameter of said fluid chamber being greater than the diameter of said food product chamber to facilitate placing a product in said food product chamber under at least about 700 psi of pressure during said expulsion stroke;

(3) an inlet valve adapted to open said inlet during said uptake stroke, and to close said inlet during said expulsion stroke;

(4) an outlet valve adapted to open said outlet during said expulsion stroke, and to close said outlet during said uptake stroke; and (5) a spray nozzle in fluid communication with said outlet;

wherein said spray nozzle is adapted to spray said product in a direction substantially transverse to said food product outlet direction during said expulsion stroke.

16. An apparatus according to claim 15 wherein said container transport apparatus is selected from the group consisting of a linear transport apparatus and a turntable transport apparatus.

17. An apparatus according to claim 15 additionally comprising a food product circulation pump adapted to supply said inlet with a flow of said food product.

18. An apparatus for distributing a spray of a food product into a series of containers, said apparatus comprising:

(A) a container transport apparatus adapted to transport said containers in a series to and beyond a filling position; and (B) a filling apparatus positioned so as to fill one of said containers when said one of said containers is in said filling position, said filling apparatus comprising a reciprocating valve, said reciprocating valve comprising:

(1) a food product chamber, said food product chamber comprising a cylinder and a piston adapted to move within said cylinder, said cylinder having an inlet and an outlet, said food product chamber having a bottom and said outlet being located in the bottom of said food product chamber so as to provide a food product outlet direction;

(2) a fluid chamber adapted to actuate said piston in a reciprocating motion comprising an uptake stroke and an expulsion stroke, the diameter of said fluid chamber being greater than the diameter of said food product chamber;

(3) an inlet valve adapted to open said inlet during said uptake stroke, and to close said inlet during said expulsion stroke;

(4) an outlet valve adapted to open said outlet during said expulsion stroke, and to close said outlet during said uptake stroke; and (5) a reciprocating mechanism adapted to raise and lower said food product chamber, said fluid chamber, said inlet valve, and said outlet valve in a reciprocating motion along an axis substantially parallel to said food product outlet direction.

19. An apparatus according to claim 18 wherein said container transport apparatus is selected from the group consisting of a linear transport apparatus and a turntable transport apparatus.

20. An apparatus according to claim 18 wherein said reciprocating valve comprises a spray nozzle that extends into said one of said containers or a respective container holder when said one of said containers is in said filling position, such that said spray nozzle reciprocates within said one of said containers or said container holder during said expulsion stroke.

21. An apparatus according to claim 18 additionally comprising a food product circulation pump adapted to supply said inlet with a flow of said food product.

22. A method of dispensing a food product into a container, said method comprising:

(A) maintaining a flow of said food product;

(B) conducting said flow of said food product into at least one valve, said valve comprising:

(1) a food product chamber, said food product chamber comprising a cylinder and a piston adapted to move within said cylinder, said cylinder having an inlet and an outlet;

(2) a fluid chamber adapted to actuate said piston in a reciprocating motion comprising an uptake stroke and an expulsion stroke, the diameter of said fluid chamber being greater than the diameter of said food product chamber;

(3) an inlet valve adapted to open said inlet during said uptake stroke, and to close said inlet during said expulsion stroke; and (4) an outlet valve adapted to open said outlet during said expulsion stroke, and to close said outlet during said uptake stroke;

(C) transporting said container to a filling position beneath said valve; and (D) actuating said valve so as to pump said food product through said outlet into said container while reciprocating said outlet within the space defined by said container or a respective container holder so as to coat the inside of said container with said food product.

23. A method of dispensing a food product into a container, said method comprising:

(A) maintaining a flow of said food product;

(B) conducting said flow of said food product into at least one valve, said valve comprising:

(1) a food product chamber, said food product chamber comprising a cylinder and a piston adapted to move within said cylinder, said cylinder having an inlet and an outlet, said food product chamber having a bottom and said outlet being located in the bottom of said food product chamber so as to provide a food product outlet direction;

(2) a fluid chamber adapted to actuate said piston in a reciprocating motion comprising an uptake stroke and an expulsion stroke, the diameter of said fluid chamber being greater than the diameter of said food product chamber;

(3) an inlet valve adapted to open said inlet during said uptake stroke, and to close said inlet during said expulsion stroke;

(4) an outlet valve adapted to open said outlet during said expulsion stroke, and to close said outlet during said uptake stroke; and (5) a reciprocating mechanism adapted to raise and lower said food product chamber, said fluid chamber, said inlet valve, and said outlet valve in a reciprocating motion along an axis substantially parallel to said food product outlet direction;

(C) transporting said container to a filling position beneath said valve; and (D) actuating said valve so as to pump said food product through said outlet into said container while reciprocating said outlet within the space defined by said container or a respective container holder so as to coat the inside of said container with said food product.

* * * * *